US009220956B2

(12) United States Patent
Beach et al.

(10) Patent No.: US 9,220,956 B2
(45) **Date of Patent: *Dec. 29, 2015**

(54) GOLF CLUB

(71) Applicant: Taylor Made Golf Company, Inc., Carlsbad, CA (US)

(72) Inventors: Todd P. Beach, Encinitas, CA (US); Joseph Henry Hoffman, Carlsbad, CA (US); Scott Taylor, Bonita, CA (US); Sang S. Yi, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/196,254

(22) Filed: Mar. 4, 2014

(65) Prior Publication Data

US 2014/0179460 A1 Jun. 26, 2014

Related U.S. Application Data

(63) Continuation of application No. 13/401,690, filed on Feb. 21, 2012, now Pat. No. 8,663,029, which is a continuation of application No. 13/010,579, filed on Jan. 20, 2011, now Pat. No. 8,118,689, which is a (Continued)

(51) Int. Cl.

| | |
|---|---|
| ***A63B 53/02*** | (2015.01) |
| ***A63B 53/04*** | (2015.01) |
| ***A63B 53/06*** | (2015.01) |

(52) U.S. Cl.

CPC ..... *A63B 53/0466* (2013.01); *A63B 53/06* (2013.01); *A63B 2053/0408* (2013.01);

(Continued)

(58) Field of Classification Search

CPC ..... A63B 53/0466; A63B 2053/0408; A63B 2053/0416; A63B 2053/0491; A63B 2209/023; A63B 53/06; A63B 2053/0412; A63B 2209/02; A63B 2209/00; A63B 2053/0433

USPC ..... 473/324–350, 287–292

See application file for complete search history.

(56) References Cited

U.S. PATENT DOCUMENTS

| | | | |
|---|---|---|---|
| 411,100 | A | 9/1889 | Anderson |
| 1,133,129 | A | 3/1915 | Govan |

(Continued)

FOREIGN PATENT DOCUMENTS

| | | |
|---|---|---|
| CN | 2436182 | 6/2001 |
| CN | 201353407 | 12/2009 |

(Continued)

OTHER PUBLICATIONS

Adams Golf Speedline F11 Ti 14.5 degree fairway wood (www.bombsquadgolf.com, posted Oct. 18, 2010).

(Continued)

*Primary Examiner* — Sebastiano Passaniti

(74) *Attorney, Agent, or Firm* — Klarquist Sparkman, LLP

(57) ABSTRACT

A golf club head includes a body defining an interior cavity. The body includes a sole positioned at a bottom portion of the golf club head, a crown positioned at a top portion, and a skirt positioned around a periphery between the sole and crown. The body has a forward portion and a rearward portion. The club head includes a face positioned at the forward portion of the body. The face defines a striking surface having an ideal impact location at a golf club head origin. Some embodiments of the club head form a club head for a fairway wood that has a high moment of inertia, a low center-of-gravity and a thin crown.

26 Claims, 5 Drawing Sheets

Related U.S. Application Data continuation of application No. 12/781,727, filed on May 17, 2010, now Pat. No. 7,887,434, which is a continuation of application No. 12/011,211, filed on Jan. 23, 2008, now Pat. No. 7,753,806.

(60) Provisional application No. 61/009,743, filed on Dec. 31, 2007.

(52) U.S. Cl.
CPC . *A63B2053/0412* (2013.01); *A63B 2053/0416* (2013.01); *A63B 2053/0433* (2013.01); *A63B 2053/0491* (2013.01); *A63B 2209/00* (2013.01); *A63B 2209/02* (2013.01); *A63B 2209/023* (2013.01)

(56) References Cited

U.S. PATENT DOCUMENTS

| | | | |
|---|---|---|---|
| 1,518,316 | A | 12/1924 | Ellingham |
| 1,526,438 | A | 2/1925 | Scott |
| 1,538,312 | A | 5/1925 | Beat |
| 1,592,463 | A | 7/1926 | Marker |
| 1,658,581 | A | 2/1928 | Tobia |
| 1,704,119 | A | 3/1929 | Buhrke |
| 1,970,409 | A | 8/1934 | Wiedemann |
| D107,007 | S | 11/1937 | Cashmore |
| 2,214,356 | A | 9/1940 | Wettlaufer |
| 2,225,930 | A | 12/1940 | Sexton |
| 2,360,364 | A | 10/1944 | Reach |
| 2,375,249 | A | 5/1945 | Richer |
| 2,460,435 | A | 2/1949 | Schaffer |
| 2,681,523 | A | 6/1954 | Sellers |
| 3,064,980 | A | 11/1962 | Steiner |
| 3,466,047 | A | 9/1969 | Rodia et al. |
| 3,486,755 | A | 12/1969 | Hodge |
| 3,556,533 | A | 1/1971 | Hollis |
| 3,589,731 | A | 6/1971 | Chancellor |
| 3,606,327 | A | 9/1971 | Gorman |
| 3,610,630 | A | 10/1971 | Glover |
| 3,652,094 | A | 3/1972 | Glover |
| 3,672,419 | A | 6/1972 | Fischer |
| 3,692,306 | A | 9/1972 | Glover |
| 3,743,297 | A | 7/1973 | Dennis |
| 3,897,066 | A | 7/1975 | Belmont |
| 3,976,299 | A | 8/1976 | Lawrence et al. |
| 3,979,122 | A | 9/1976 | Belmont |
| 3,979,123 | A | 9/1976 | Belmont |
| 4,008,896 | A | 2/1977 | Gordos |
| 4,043,563 | A | 8/1977 | Churchward |
| 4,052,075 | A | 10/1977 | Daly |
| 4,076,254 | A | 2/1978 | Nygren |
| 4,085,934 | A | 4/1978 | Churchward |
| 4,121,832 | A | 10/1978 | Ebbing |
| 4,150,702 | A | 4/1979 | Holmes |
| 4,189,976 | A | 2/1980 | Becker |
| 4,214,754 | A | 7/1980 | Zebelean |
| 4,262,562 | A | 4/1981 | MacNeill |
| D259,698 | S | 6/1981 | MacNeill |
| 4,340,229 | A | 7/1982 | Stuff, Jr. |
| 4,411,430 | A | 10/1983 | Dian |
| 4,423,874 | A | 1/1984 | Stuff, Jr. |
| 4,438,931 | A | 3/1984 | Motomiya |
| 4,489,945 | A | 12/1984 | Kobayashi |
| 4,530,505 | A | 7/1985 | Stuff |
| D284,346 | S | 6/1986 | Masters |
| 4,602,787 | A | 7/1986 | Sugioka et al. |
| 4,607,846 | A | 8/1986 | Perkins |
| 4,712,798 | A | 12/1987 | Preato |
| 4,730,830 | A | 3/1988 | Tilley |
| 4,736,093 | A | 4/1988 | Braly |
| 4,754,977 | A | 7/1988 | Sahm |
| 4,762,322 | A | 8/1988 | Molitor et al. |
| 4,795,159 | A | 1/1989 | Nagamoto |
| 4,803,023 | A | 2/1989 | Enomoto et al. |
| 4,867,457 | A | 9/1989 | Lowe |
| 4,867,458 | A | 9/1989 | Sumikawa et al. |
| 4,869,507 | A | 9/1989 | Sahm |
| 4,895,371 | A | 1/1990 | Bushner |
| 4,915,558 | A | 4/1990 | Muller |
| 4,962,932 | A | 10/1990 | Anderson |
| 4,994,515 | A | 2/1991 | Washiyama et al. |
| 5,006,023 | A | 4/1991 | Kaplan |
| 5,020,950 | A | 6/1991 | Ladouceur |
| 5,028,049 | A | 7/1991 | McKeighen |
| 5,039,267 | A | 8/1991 | Wollar |
| 5,050,879 | A | 9/1991 | Sun et al. |
| 5,058,895 | A | 10/1991 | Igarashi |
| 5,078,400 | A | 1/1992 | Desbiolles et al. |
| 5,121,922 | A | 6/1992 | Harsh, Sr. |
| 5,122,020 | A | 6/1992 | Bedi |
| 5,244,210 | A | 9/1993 | Au |
| 5,251,901 | A | 10/1993 | Solheim et al. |
| 5,253,869 | A | 10/1993 | Dingle et al. |
| D343,558 | S | 1/1994 | Latraverse et al. |
| 5,297,794 | A | 3/1994 | Lu |
| 5,316,305 | A | 5/1994 | McCabe |
| 5,320,005 | A | 6/1994 | Hsiao |
| 5,328,176 | A | 7/1994 | Lo |
| 5,346,217 | A | 9/1994 | Tsuchiya et al. |
| 5,385,348 | A | 1/1995 | Wargo |
| 5,395,113 | A | 3/1995 | Antonious |
| 5,410,798 | A | 5/1995 | Lo |
| 5,419,556 | A | 5/1995 | Take |
| 5,421,577 | A | 6/1995 | Kobayashi |
| 5,429,365 | A | 7/1995 | McKeighen |
| 5,439,222 | A | 8/1995 | Kranenberg |
| 5,441,274 | A | 8/1995 | Clay |
| 5,447,309 | A | 9/1995 | Vincent |
| 5,449,260 | A | 9/1995 | Whittle |
| D365,615 | S | 12/1995 | Shimatani |
| 5,518,243 | A | 5/1996 | Redman |
| 5,533,730 | A | 7/1996 | Ruvang |
| 5,564,705 | A | 10/1996 | Kobayashi et al. |
| 5,571,053 | A | 11/1996 | Lane |
| 5,573,467 | A | 11/1996 | Chou et al. |
| 5,582,553 | A | 12/1996 | Ashcraft et al. |
| 5,613,917 | A | 3/1997 | Kobayashi et al. |
| 5,620,379 | A | 4/1997 | Borys |
| 5,624,331 | A | 4/1997 | Lo et al. |
| 5,629,475 | A | 5/1997 | Chastonay |
| 5,632,694 | A | 5/1997 | Lee |
| 5,658,206 | A | 8/1997 | Antonious |
| 5,669,827 | A | 9/1997 | Nagamoto |
| 5,683,309 | A | 11/1997 | Reimers |
| 5,688,189 | A | 11/1997 | Bland |
| 5,709,613 | A | 1/1998 | Sheraw |
| 5,718,641 | A | 2/1998 | Lin |
| 5,720,674 | A | 2/1998 | Galy |
| D392,526 | S | 3/1998 | Nicely |
| 5,746,664 | A | 5/1998 | Reynolds, Jr. |
| 5,755,627 | A | 5/1998 | Yamazaki et al. |
| 5,762,567 | A | 6/1998 | Antonious |
| 5,766,095 | A | 6/1998 | Antonious |
| 5,769,737 | A | 6/1998 | Holladay et al. |
| 5,776,010 | A | 7/1998 | Helmstetter et al. |
| 5,776,011 | A | 7/1998 | Su et al. |
| 5,788,587 | A | 8/1998 | Tseng |
| 5,798,587 | A | 8/1998 | Lee |
| RE35,955 | E | 11/1998 | Lu |
| 5,851,160 | A | 12/1998 | Rugge et al. |
| D409,463 | S | 5/1999 | McMullin |
| 5,908,356 | A | 6/1999 | Nagamoto |
| 5,911,638 | A | 6/1999 | Parente et al. |
| 5,913,735 | A | 6/1999 | Kenmi |
| 5,916,042 | A | 6/1999 | Reimers |
| D412,547 | S | 8/1999 | Fong |
| 5,935,019 | A | 8/1999 | Yamamoto |
| 5,935,020 | A | 8/1999 | Stites et al. |
| 5,941,782 | A | 8/1999 | Cook |
| 5,947,840 | A | 9/1999 | Ryan |
| 5,967,905 | A | 10/1999 | Nakahara et al. |
| 5,971,867 | A | 10/1999 | Galy |
| 5,976,033 | A | 11/1999 | Takeda |
| 5,997,415 | A | 12/1999 | Wood |

(56) References Cited

U.S. PATENT DOCUMENTS 6,015,354 A 1/2000 Ahn et al.
6,017,177 A 1/2000 Lanham
6,019,686 A 2/2000 Gray
6,023,891 A 2/2000 Robertson et al.
6,032,677 A 3/2000 Blechman et al.
6,033,318 A 3/2000 Drajan, Jr. et al.
6,033,321 A 3/2000 Yamamoto
6,056,649 A 5/2000 Imai
6,062,988 A 5/2000 Yamamoto
6,077,171 A 6/2000 Yoneyama
6,089,994 A 7/2000 Sun
6,123,627 A 9/2000 Antonious
6,149,533 A 11/2000 Finn
6,162,132 A 12/2000 Yoneyama
6,162,133 A 12/2000 Peterson
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphy et al.
6,254,494 B1 7/2001 Hasebe et al.
6,264,414 B1 7/2001 Hartmann et al.
6,270,422 B1 8/2001 Fisher
6,277,032 B1 8/2001 Smith
6,290,609 B1 9/2001 Takeda
6,296,579 B1 10/2001 Robinson
6,299,547 B1 10/2001 Kosmatka
6,306,048 B1 10/2001 McCabe et al.
6,334,817 B1 1/2002 Ezawa et al.
6,338,683 B1 1/2002 Kosmatka
6,340,337 B2 1/2002 Hasebe et al.
6,348,012 B1 2/2002 Erickson et al.
6,348,013 B1 2/2002 Kosmatka
6,348,014 B1 2/2002 Chiu
6,364,788 B1 4/2002 Helmstetter et al.
6,379,264 B1 4/2002 Forzano
6,379,265 B1 4/2002 Hirakawa et al.
6,383,090 B1 5/2002 O'Doherty et al.
6,386,987 B1 5/2002 Lejeune, Jr.
6,386,990 B1 5/2002 Reyes et al.
6,390,933 B1 5/2002 Galloway et al.
6,409,612 B1 6/2002 Evans et al.
6,425,832 B2 7/2002 Cackett et al.
6,434,811 B1 8/2002 Helmstetter et al.
6,436,142 B1 8/2002 Paes et al.
6,440,009 B1 8/2002 Guibaud et al.
6,440,010 B1 8/2002 Deshmukh
6,443,851 B1 9/2002 Liberatore
6,458,044 B1 10/2002 Vincent et al.
6,461,249 B2 10/2002 Liberatore
6,471,604 B2 10/2002 Hocknell et al.
6,475,101 B2 11/2002 Burrows
6,475,102 B2 11/2002 Helmstetter et al.
6,491,592 B2 12/2002 Cackett et al.
6,508,978 B1 1/2003 Deshmukh
6,514,154 B1 2/2003 Finn
6,524,197 B2 2/2003 Boone
6,524,198 B2 2/2003 Takeda
6,527,649 B1 3/2003 Neher et al.
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,448 B2 5/2003 Cameron et al.
6,565,452 B2 5/2003 Helmstetter et al.
6,569,029 B1 5/2003 Hamburger
6,569,040 B2 5/2003 Bradstock
6,572,489 B2 6/2003 Miyamoto et al.
6,575,845 B2 6/2003 Galloway et al.
6,582,323 B2 6/2003 Soracco et al.
6,592,468 B2 7/2003 Vincent et al.
6,602,149 B1 8/2003 Jacobson
6,605,007 B1 8/2003 Bissonnette et al.
6,607,452 B2 8/2003 Helmstetter et al.
6,612,938 B2 9/2003 Murphy et al.
6,616,547 B2 9/2003 Vincent et al.
6,638,180 B2 10/2003 Tsurumaki
6,638,183 B2 10/2003 Takeda
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
6,663,506 B2 12/2003 Nishimoto et al.
6,669,571 B1 12/2003 Cameron et al.
6,669,578 B1 12/2003 Evans
6,669,580 B1 12/2003 Cackett et al.
6,676,536 B1 1/2004 Jacobson
6,679,786 B2 1/2004 McCabe
6,716,111 B2 4/2004 Liberatore
6,716,114 B2 4/2004 Nishio
6,719,510 B2 4/2004 Cobzaru
6,719,641 B2 4/2004 Dabbs et al.
6,739,982 B2 5/2004 Murphy et al.
6,739,983 B2 5/2004 Helmstetter et al.
6,743,118 B1 6/2004 Soracco
6,749,523 B1 6/2004 Forzano
6,757,572 B1 6/2004 Forest
6,758,763 B2 7/2004 Murphy et al.
6,773,360 B2 8/2004 Willett et al.
6,773,361 B1 8/2004 Lee
6,776,726 B2 8/2004 Sano
6,800,038 B2 10/2004 Willett et al.
6,805,643 B1 10/2004 Lin
6,808,460 B2 10/2004 Namiki
6,824,475 B2 11/2004 Burnett et al.
6,835,145 B2 12/2004 Tsurumaki
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,881,158 B2 4/2005 Yang et al.
6,881,159 B2 4/2005 Galloway et al.
6,887,165 B2 5/2005 Tsurumaki
6,890,267 B2 5/2005 Mahaffey et al.
6,904,663 B2 6/2005 Willett et al.
6,923,734 B2 8/2005 Meyer
6,926,619 B2 8/2005 Helmstetter et al.
6,960,142 B2 11/2005 Bissonnette et al.
6,964,617 B2 11/2005 Williams
6,974,393 B2 12/2005 Caldwell et al.
6,988,960 B2 1/2006 Mahaffey et al.
6,991,558 B2 1/2006 Beach et al.
D515,165 S 2/2006 Zimmerman et al.
6,997,820 B2 2/2006 Willett et al.
7,004,852 B2 2/2006 Billings
7,025,692 B2 4/2006 Erickson et al.
7,029,403 B2 4/2006 Rice et al.
7,077,762 B2 7/2006 Kouno et al.
7,137,905 B2 11/2006 Kohno
7,137,906 B2 11/2006 Tsunoda et al.
7,140,974 B2 11/2006 Chao et al.
7,147,573 B2 12/2006 DiMarco
7,153,220 B2 12/2006 Lo
7,163,468 B2 1/2007 Gibbs et al.
7,166,038 B2 1/2007 Williams et al.
7,166,040 B2 1/2007 Hoffman et al.
7,166,041 B2 1/2007 Evans
7,169,060 B2 1/2007 Stevens et al.
7,179,034 B2 2/2007 Ladouceur
7,186,190 B1 3/2007 Beach et al.
7,189,169 B2 3/2007 Billings
7,198,575 B2 4/2007 Beach et al.
7,201,669 B2 4/2007 Stites et al.
7,223,180 B2 5/2007 Willett et al.
7,252,600 B2 8/2007 Murphy et al.

(56) References Cited

U.S. PATENT DOCUMENTS

| | | | | |
|---|---|---|---|---|
| 7,255,654 | B2 | 8/2007 | Murphy et al. | |
| 7,267,620 | B2 | 9/2007 | Chao et al. | |
| 7,273,423 | B2 | 9/2007 | Imamoto | |
| 7,278,927 | B2 | 10/2007 | Gibbs et al. | |
| 7,294,064 | B2 | 11/2007 | Tsurumaki et al. | |
| 7,294,065 | B2 | 11/2007 | Liang et al. | |
| 7,377,860 | B2 | 5/2008 | Breier et al. | |
| 7,407,447 | B2 | 8/2008 | Beach et al. | |
| 7,419,441 | B2 | 9/2008 | Hoffman et al. | |
| 7,448,963 | B2 | 11/2008 | Beach et al. | |
| 7,500,924 | B2 | 3/2009 | Yokota | |
| 7,520,820 | B2 | 4/2009 | Dimarco | |
| 7,530,901 | B2 | 5/2009 | Imamoto et al. | |
| 7,530,904 | B2 | 5/2009 | Beach et al. | |
| 7,540,811 | B2 | 6/2009 | Beach et al. | |
| 7,563,175 | B2 | 7/2009 | Nishitani et al. | |
| 7,568,985 | B2 | 8/2009 | Beach et al. | |
| 7,572,193 | B2 | 8/2009 | Yokota | |
| 7,578,753 | B2 | 8/2009 | Beach et al. | |
| 7,582,024 | B2 | 9/2009 | Shear | |
| 7,591,737 | B2 | 9/2009 | Gibbs et al. | |
| 7,591,738 | B2 | 9/2009 | Beach et al. | |
| 7,621,823 | B2 | 11/2009 | Beach et al. | |
| 7,628,707 | B2 | 12/2009 | Beach et al. | |
| 7,632,194 | B2 | 12/2009 | Beach et al. | |
| 7,632,196 | B2 | 12/2009 | Reed et al. | |
| D612,440 | S | 3/2010 | Oldknow | |
| 7,674,189 | B2 | 3/2010 | Beach et al. | |
| 7,744,484 | B1 | 6/2010 | Chao | |
| 7,753,806 | B2 | 7/2010 | Beach et al. | |
| 7,771,291 | B1 | 8/2010 | Willett et al. | |
| 7,857,711 | B2 | 12/2010 | Shear | |
| 7,887,434 | B2 | 2/2011 | Beach et al. | |
| 7,946,931 | B2 | 5/2011 | Oyama | |
| 8,012,038 | B1 | 9/2011 | Beach et al. | |
| 8,118,689 | B2 | 2/2012 | Beach et al. | |
| 8,430,763 | B2 | 4/2013 | Beach et al. | |
| 8,496,544 | B2 | 7/2013 | Curtis et al. | |
| 8,663,029 | B2 * | 3/2014 | Beach et al. | 473/334 |
| 8,753,222 | B2 * | 6/2014 | Beach et al. | 473/307 |
| 8,888,607 | B2 * | 11/2014 | Harbert et al. | 473/307 |
| 8,900,069 | B2 * | 12/2014 | Beach et al. | 473/329 |
| 8,956,240 | B2 * | 2/2015 | Beach et al. | 473/307 |
| 2001/0049310 | A1 | 12/2001 | Cheng et al. | |
| 2002/0022535 | A1 | 2/2002 | Takeda | |
| 2002/0032075 | A1 | 3/2002 | Vatsvog | |
| 2002/0055396 | A1 | 5/2002 | Nishimoto et al. | |
| 2002/0072434 | A1 | 6/2002 | Yabu | |
| 2002/0123394 | A1 | 9/2002 | Tsurumaki | |
| 2002/0137576 | A1 | 9/2002 | Dammen | |
| 2002/0160854 | A1 | 10/2002 | Beach et al. | |
| 2003/0032500 | A1 | 2/2003 | Nakahara et al. | |
| 2003/0130059 | A1 | 7/2003 | Billings | |
| 2004/0087388 | A1 | 5/2004 | Beach et al. | |
| 2004/0157678 | A1 | 8/2004 | Kohno | |
| 2004/0176183 | A1 | 9/2004 | Tsurumaki | |
| 2004/0192463 | A1 | 9/2004 | Tsurumaki et al. | |
| 2004/0235584 | A1 | 11/2004 | Chao et al. | |
| 2004/0242343 | A1 | 12/2004 | Chao | |
| 2005/0101404 | A1 | 5/2005 | Long et al. | |
| 2005/0137024 | A1 | 6/2005 | Stites et al. | |
| 2005/0181884 | A1 | 8/2005 | Beach et al. | |
| 2005/0239575 | A1 | 10/2005 | Chao et al. | |
| 2005/0239576 | A1 | 10/2005 | Stites et al. | |
| 2006/0035722 | A1 | 2/2006 | Beach et al. | |
| 2006/0058112 | A1 | 3/2006 | Haralason et al. | |
| 2006/0122004 | A1 | 6/2006 | Chen et al. | |
| 2006/0154747 | A1 | 7/2006 | Beach et al. | |
| 2006/0172821 | A1 | 8/2006 | Evans | |
| 2006/0240908 | A1 | 10/2006 | Adams et al. | |
| 2007/0026961 | A1 | 2/2007 | Hou | |
| 2007/0049417 | A1 | 3/2007 | Shear | |
| 2007/0105646 | A1 | 5/2007 | Beach et al. | |
| 2007/0105647 | A1 | 5/2007 | Beach et al. | |
| 2007/0105648 | A1 | 5/2007 | Beach et al. | |
| 2007/0105649 | A1 | 5/2007 | Beach et al. | |
| 2007/0105650 | A1 | 5/2007 | Beach et al. | |
| 2007/0105651 | A1 | 5/2007 | Beach et al. | |
| 2007/0105652 | A1 | 5/2007 | Beach et al. | |
| 2007/0105653 | A1 | 5/2007 | Beach et al. | |
| 2007/0105654 | A1 | 5/2007 | Beach et al. | |
| 2007/0105655 | A1 | 5/2007 | Beach et al. | |
| 2007/0117652 | A1 | 5/2007 | Beach et al. | |
| 2008/0146370 | A1 | 6/2008 | Beach et al. | |
| 2008/0161127 | A1 | 7/2008 | Yamamoto | |
| 2008/0261717 | A1 | 10/2008 | Hoffman et al. | |
| 2008/0280698 | A1 | 11/2008 | Hoffman et al. | |
| 2009/0088269 | A1 | 4/2009 | Beach et al. | |
| 2009/0088271 | A1 | 4/2009 | Beach et al. | |
| 2009/0137338 | A1 | 5/2009 | Kajita | |
| 2009/0170632 | A1 | 7/2009 | Beach et al. | |
| 2010/0048316 | A1 | 2/2010 | Honea et al. | |
| 2010/0048321 | A1 | 2/2010 | Beach et al. | |
| 2010/0113176 | A1 | 5/2010 | Boyd et al. | |
| 2011/0021284 | A1 | 1/2011 | Stites et al. | |
| 2011/0151989 | A1 | 6/2011 | Golden et al. | |
| 2011/0151997 | A1 | 6/2011 | Shear | |
| 2011/0218053 | A1 | 9/2011 | Tang et al. | |
| 2011/0294599 | A1 | 12/2011 | Albertsen et al. | |
| 2012/0142447 | A1 | 6/2012 | Boyd et al. | |
| 2012/0149491 | A1 | 6/2012 | Beach et al. | |
| 2012/0202615 | A1 | 8/2012 | Beach et al. | |
| 2012/0220387 | A1 | 8/2012 | Beach et al. | |
| 2012/0289361 | A1 | 11/2012 | Beach et al. | |

FOREIGN PATENT DOCUMENTS

| | | | |
|---|---|---|---|
| DE | 9012884 | | 9/1990 |
| EP | 0470488 | B1 | 3/1995 |
| EP | 0617987 | B1 | 11/1997 |
| EP | 1001175 | A2 | 5/2000 |
| GB | 194823 | | 12/1921 |
| JP | 57-157374 | | 10/1982 |
| JP | 4180778 | | 6/1992 |
| JP | 05-317465 | | 12/1993 |
| JP | 06-126004 | | 5/1994 |
| JP | 06-238022 | | 8/1994 |
| JP | 6-304271 | | 11/1994 |
| JP | 09-028844 | | 2/1997 |
| JP | 09-308717 | | 12/1997 |
| JP | 09-327534 | | 12/1997 |
| JP | 10-234902 | | 8/1998 |
| JP | 10-277187 | | 10/1998 |
| JP | 2000014841 | | 1/2000 |
| JP | 2001054595 | | 2/2001 |
| JP | 2001-129130 | | 5/2001 |
| JP | 2001170225 | | 6/2001 |
| JP | 2001204856 | | 7/2001 |
| JP | 2001346918 | | 12/2001 |
| JP | 2002003969 | | 1/2002 |
| JP | 2002017910 | | 1/2002 |
| JP | 2002052099 | | 2/2002 |
| JP | 2002248183 | | 9/2002 |
| JP | 2002253706 | | 9/2002 |
| JP | 2003038691 | | 2/2003 |
| JP | 2003126311 | | 5/2003 |
| JP | 2003226952 | | 8/2003 |
| JP | 2004174224 | | 6/2004 |
| JP | 2004183058 | | 7/2004 |
| JP | 2004222911 | | 8/2004 |
| JP | 2004-261451 | | 9/2004 |
| JP | 2004267438 | | 9/2004 |
| JP | 2005028170 | | 2/2005 |
| JP | 05-296582 | | 10/2005 |
| JP | 2005-296458 | | 10/2005 |
| JP | 05-323978 | | 11/2005 |
| JP | 2006-320493 | | 11/2006 |
| JP | 04128970 | | 7/2008 |
| JP | 2009000281 | | 1/2009 |
| WO | WO88/02642 | | 4/1988 |
| WO | WO01/66199 | | 9/2001 |
| WO | WO02/062501 | | 8/2002 |

(56) References Cited

FOREIGN PATENT DOCUMENTS

| | | |
|---|---|---|
| WO | WO03/061773 | 7/2003 |
| WO | WO2004/043549 | 5/2004 |
| WO | WO2006/044631 | 4/2006 |

OTHER PUBLICATIONS

Callaway Golf, World's Straightest Driver: FT-i Driver downloaded from www.callawaygolf.com/ft%2Di/driver.aspx?lang=en on Apr. 5, 2007.
Declaration of Tim Reed, VP of R&D, Adams Golf, Inc., dated Dec. 7, 2012.
Jackson, Jeff, The Modern Guide to Golf Clubmaking, Ohio: Dynacraft Golf Products, Inc., copyright 1994, p. 237.
Nike Golf, Sasquatch 460, downloaded from www.nike.com/nikegolf/index.htm on Apr. 5, 2007.
Nike Golf, Sasquatch Sumo Squared Driver, downloaded from www.nike.com/nikegolf/index.htm on Apr. 5, 2007.
Office action from the Japanese Patent Office in Japanese Patent Application No. 2008-264880, dated Nov. 21, 2012.
Office action from the U.S. Patent and Trademark Office in U.S. Appl. No. 12/781,727, dated Aug. 5, 2010.
Office action from the U.S. Patent and Trademark Office in U.S. Appl. No. 13/401,690, dated May 23, 2012.
Office action from the U.S. Patent and Trademark Office in U.S. Appl. No. 13/401,690, dated Feb. 6, 2013.
Office action from the U.S. Patent and Trademark Office in U.S. Appl. No. 13/469,023, dated Jul. 31, 2012.
Office action from the U.S. Patent and Trademark Office in U.S. Appl. No. 13/975,106, dated Feb. 24, 2014.
Taylor Made Golf Company, Inc. Press Release, Burner Fairway Wood, www.tmag.com/media/pressreleases/2007/011807_burner_fairway_rescue.html, Jan. 26, 2007.
Taylor Made Golf Company Inc., R7 460 Drivers, downloaded from www.taylormadegolf.com/product_detail.asp?pID=14section=overview on Apr. 5, 2007.
Titleist 907D1, downloaded from www.tees2greens.com/forum/Uploads/Images/7ade3521-192b-4611-870b-395d.jpg on Feb. 1, 2007.

* cited by examiner

GOLF CLUB

CROSS REFERENCE TO RELATED APPLICATION

This application is a continuation of U.S. patent application Ser. No. 13/401,690, filed Feb. 21, 2013, which is a continuation of U.S. patent application Ser. No. 13/010,579, filed Jan. 20, 2011, now U.S. Pat. No. 8,118,689, which is a continuation of U.S. patent application Ser. No. 12/781,727, filed May 17, 2010, now U.S. Pat. No. 7,887,434, which is a continuation of U.S. patent application Ser. No. 12/011,211, filed Jan. 23, 2008, now U.S. Pat. No. 7,753,806, which claims the benefit of provisional U.S. Patent Application No. 61/009,743, filed Dec. 31, 2007. These prior related applications are incorporated herein by reference.

FIELD

The present application concerns golf club heads, and more particularly, golf club heads having unique relationships between the club head's mass moments of inertia and center-of-gravity position.

BACKGROUND

Center-of-gravity (CG) and mass moments of inertia critically affect a golf club head's performance, such as launch angle and flight trajectory on impact with a golf ball, among other characteristics.

A mass moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing distance of a mass from a given axis results in an increased moment of inertia of the mass about that axis. Higher golf club head moments of inertia result in lower golf club head rotation on impact with a golf ball, particularly on "off-center" impacts with a golf ball, e.g., mis-hits. Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Most fairway wood club heads are intended to hit the ball directly from the ground, e.g., the fairway, although many golfers also use fairway woods to hit a ball from a tee. Accordingly, fairway woods are subject to certain design constraints to maintain playability. For example, compared to typical drivers, which are usually designed to hit balls from a tee, fairway woods often have a relatively shallow head height, providing a low center of gravity and a smaller top view profile for reducing contact with the ground. Such fairway woods inspire confidence in golfers for hitting from the ground. Also, fairway woods typically have a higher loft than most drivers, although some drivers and fairway woods share similar lofts. For example, most fairway woods have a loft greater than or equal to about 13 degrees, and most drivers have a loft between about 7 degrees and about 15 degrees.

Faced with constraints such as those just described, golf club manufacturers often must choose to improve one performance characteristic at the expense of another. For example, some conventional golf club heads offer increased moments of inertia to promote forgiveness while at the same time incurring a higher than desired CG-position and increased club head height. Club heads with high CG and/or large height might perform well when striking a ball positioned on a tee, such is the case with a driver, but not when hitting from the turf. Thus, conventional golf club heads that offer increased moments of inertia for forgiveness often do not perform well as a fairway wood club head.

Although traditional fairway wood club heads generally have a low CG, such clubs usually also suffer from correspondingly low mass moments of inertia. In part due to their low CG, traditional fairway wood club heads offer acceptable launch angle and flight trajectory when the club head strikes the ball at or near the ideal impact location on the ball striking face. But because of their low mass moments of inertia, traditional fairway wood club heads are less forgiving than club heads with high moments of inertia, which heretofore have been drivers. As already noted, conventional golf club heads that have increased mass moments of inertia, and thus are more forgiving, have been ill-suited for use as fairway woods because of their high CG.

Accordingly, to date, golf club designers and manufacturers have not offered golf club heads with high moments of inertia for improved forgiveness and low center-of-gravity for playing a ball positioned on turf.

SUMMARY

This application discloses, among other innovations, fairway wood-type golf club heads that provide improved forgiveness and playability.

The following describes golf club heads that include a body defining an interior cavity, a sole portion positioned at a bottom portion of the golf club head, a crown portion positioned at a top portion, and a skirt portion positioned around a periphery between the sole and crown. The body also has a forward portion and a rearward portion and a maximum above ground height.

Golf club heads according to a first aspect have a body height less than about 46 mm and a crown thickness less than about 0.65 mm throughout more than about 70% of the crown. The above ground center-of-gravity location, Zup, is less than about 19 mm and a moment of inertia about a center-of-gravity z-axis, $I_{zz}$, is greater than about 300 kg-mm$^2$.

Some club heads according to the first aspect provide an above ground center-of-gravity location, Zup, less than about 16 mm. Some have a loft angle greater than about 13 degrees. A moment of inertia about a golf club head center-of-gravity x-axis, $I_{xx}$, can be greater than about 170 kg-mm$^2$. A golf club head volume can be less than about 240 cm$^3$. A front to back depth ($D_{ch}$) of the club head can be greater than about 85 mm.

Golf club heads according to a second aspect have a body height less than about 46 mm and the face has a loft angle greater than about 13 degrees. An above ground center-of-gravity location, Zup, is less than about 19 mm, and satisfies, together with a moment of inertia about a center-of-gravity z-axis, $I_{zz}$, the relationship $I_{zz} \geq 13 \cdot Zup + 105$.

According to the second aspect, the above ground center-of-gravity location, Zup, can be less than about 16 mm. The volume of the golf club head can be less than about 240 cm$^3$. A front to back depth ($D_{ch}$) of the club head can be greater than about 85 mm. The crown can have a thickness less than about 0.65 mm over at least about 70% of the crown.

According to a third aspect, the crown has a thickness less than about 0.65 mm for at least about 70% of the crown, the golf club head has a front to back depth ($D_{ch}$) greater than about 85 mm, and an above ground center-of-gravity location, Zup, is less than about 19 mm. A moment of inertia about a center-of-gravity z-axis, $I_{zz}$, specified in units of kg-mm$^2$, a moment of inertia about a center-of-gravity x-axis, $I_{xx}$, specified in units of kg-mm$^2$, and, the above ground center-of-gravity location, Zup, specified in units of millimeters, together satisfy the relationship $I_{xx}+I_{zz}\geq 20\cdot Zup+165$.

In some instances, the above ground center-of-gravity above ground location, Zup, and the moment of inertia about the center-of-gravity z-axis, $I_{zz}$, specified in units of kg-mm$^2$, together satisfy the relationship $I_{zz}\geq 13\cdot Zup+105$. In some embodiments, the moment of inertia about the center-of-gravity z-axis, $I_{zz}$, exceeds one or more of 300 kg-mm$^2$, 320 kg-mm$^2$, 340 kg-mm$^2$, and 360 kg-mm$^2$ The moment of inertia about the center-of-gravity x-axis, $I_{xx}$, can exceed one or more of 150 kg-mm$^2$, 170 kg-mm$^2$, and 190 kg-mm$^2$.

Some golf club heads according to the third aspect also include one or more weight ports formed in the body and at least one weight configured to be retained at least partially within one of the one or more weight ports. The face can have a loft angle in excess of about 13 degrees. The golf club head can have a volume less than about 240 cm$^3$. The body can be substantially formed from a steel alloy, a titanium alloy, a graphitic composite, and/or a combination thereof. In some instances, the body is substantially formed as an investment casting. In some instances, the maximum height is less than one or more of about 46 mm, about 42 mm, and about 38 mm.

In golf club heads according to a fourth aspect, the crown has a thickness less than about 0.65 mm for at least about 70% of the crown, a front to back depth ($D_{ch}$) is greater than about 85 mm, and an above ground center-of-gravity location, Zup, is less than about 19 mm. In addition, a moment of inertia about a center-of-gravity x-axis, $I_{xx}$, specified in units of kg-mm$^2$, and the above ground center-of-gravity location, Zup, specified in units of millimeters, together satisfy the relationship $I_{xx}\geq 7\cdot Zup+60$.

In some instances, the above ground center-of-gravity location, Zup, and the moment of inertia about the center-of-gravity z-axis, $I_{zz}$, specified in units of kg-mm$^2$, together satisfy the relationship $I_{zz}\geq 13\cdot Zup+105$.

The moment of inertia about the center-of-gravity z-axis, $I_{zz}$, can exceed one or more of 300 kg-mm$^2$, 320 kg-mm$^2$, 340 kg-mm$^2$, and 360 kg-mm$^2$ The moment of inertia about the center-of-gravity x-axis, $I_{xx}$, can exceed one or more of 150 kg-mm$^2$, 170 kg-mm$^2$, and 190 kg-mm$^2$.

Some embodiments according to the fourth aspect also include one or more weight ports formed in the body and at least one weight configured to be retained at least partially within one of the one or more weight ports.

According to the fourth aspect, the face can have a loft angle in excess of about 13 degrees. The golf club head can have a volume less than about 240 cm$^3$. The body can be substantially formed from a selected material from a steel alloy, a titanium alloy, a graphitic composite, and/or a combination thereof. In some instances, the body is substantially formed as an investment casting. The maximum height of some club heads according to the fourth aspect is less than one or more of about 46 mm, about 42 mm, and about 38 mm.

The foregoing and other features and advantages of the golf club head will become more apparent from the following detailed description, which proceeds with reference to the accompanying figures.

DETAILED DESCRIPTION

The following describes embodiments of golf club heads for fairway woods that incorporate increased moments of inertia and low centers of gravity relative to fairway wood golf club heads that have come before.

The following makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object.

Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 1:
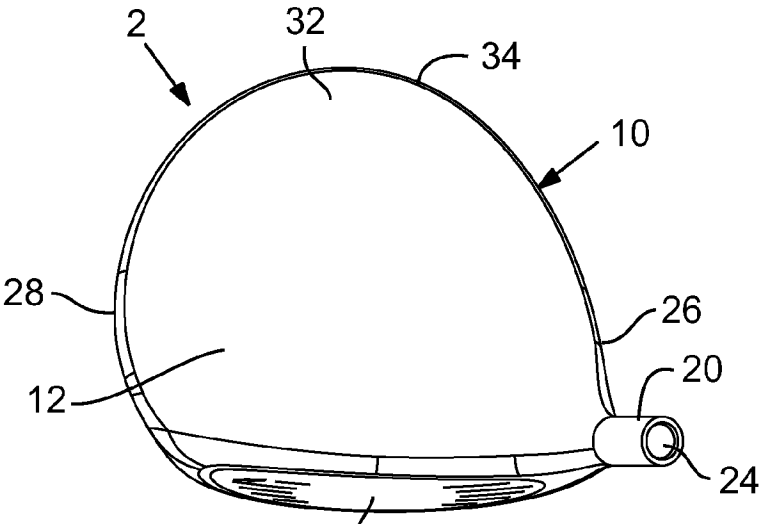
FIG. 1 is a top plan view of one embodiment of a golf club head.
Figure 3:
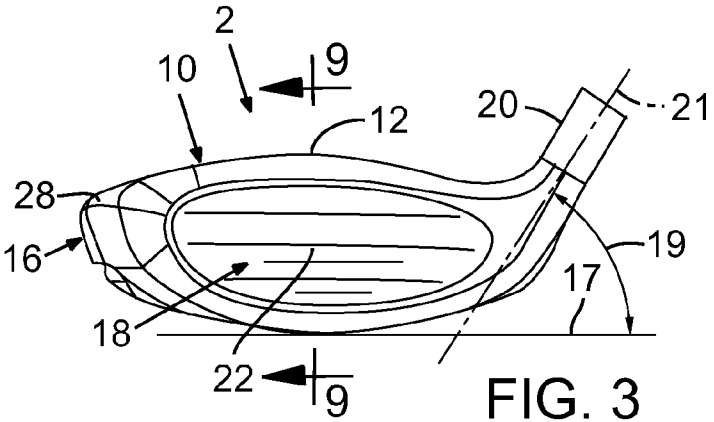
FIG. 3 is a front elevation view of the golf club head of FIG. 1.
Figure 2:
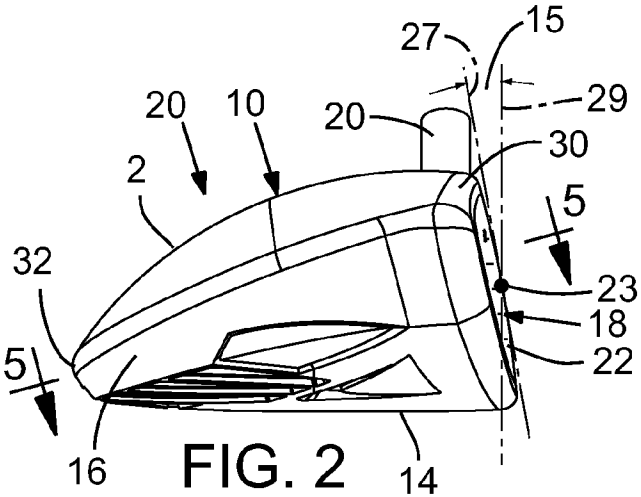
FIG. 2 is a side elevation view from a toe side of the golf club head of FIG. 1.

FIGS. 1-3 illustrate one embodiment of a fairway wood type golf club head at normal address position. FIG. 1 illustrates a top plan view of the club head 2, FIG. 2 illustrates a front elevation view of club head 2 and FIG. 3 illustrates a side elevation view from the toe side. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect.

Club Head

A fairway wood-type golf club head, such as the golf club head 2, includes a hollow body 10 defining a crown portion 12, a sole portion 14 and a skirt portion 16. A striking face, or face portion, 18 attaches to the body 10. The body 10 can include a hosel 20, which defines a hosel bore 24 adapted to receive a golf club shaft. The body 10 further includes a heel portion 26, a toe portion 28, a front portion 30, and a rear portion 32.

The club head 2 also has a volume, typically measured in cubic-centimeters ($cm^3$), equal to the volumetric displacement of the club head 2, assuming any apertures are sealed by a substantially planar surface. In some implementations, the golf club head 2 has a volume between approximately 120 $cm^3$ and approximately 240 $cm^3$, and a total mass between approximately 185 g and approximately 245 g. In a specific implementation, the golf club head 2 has a volume of approximately 181 $cm^3$ and a total mass of approximately 216 g.

Figure 9:
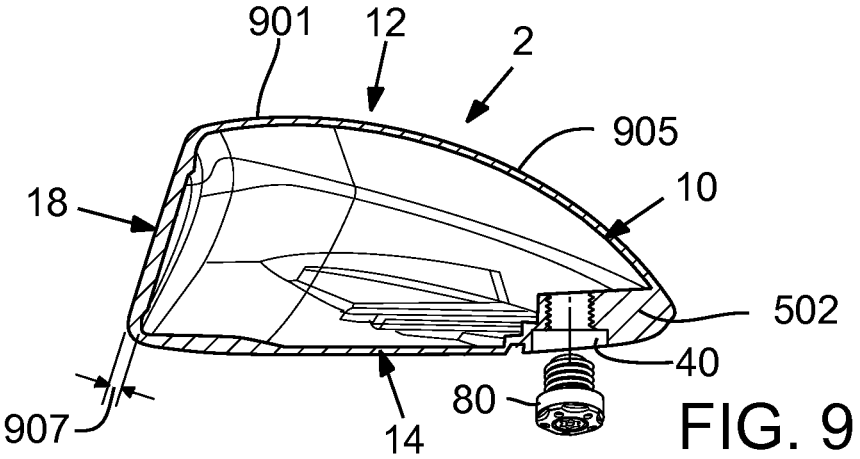
FIG. 9 is a cross-sectional view of the golf club head of FIG. 1 taken along line 9-9 of FIG. 3 showing internal features of the golf club head.

As used herein, "crown" means an upper portion of the club head above a peripheral outline 34 of the club head as viewed from a top-down direction and rearward of the topmost portion of a ball striking surface 22 of the striking face 18 (see e.g., FIGS. 1-2). FIG. 9 illustrates a cross-sectional view of the golf club head of FIG. 1 taken along line 9-9 of FIG. 3 showing internal features of the golf club head. Particularly, the crown 12 ranges in thickness from about 0.76 mm at the front crown 901, near the club face 18, to about 0.60 mm at the back crown 905, a portion of the crown near the rear of the club head 2.

Figure 5:
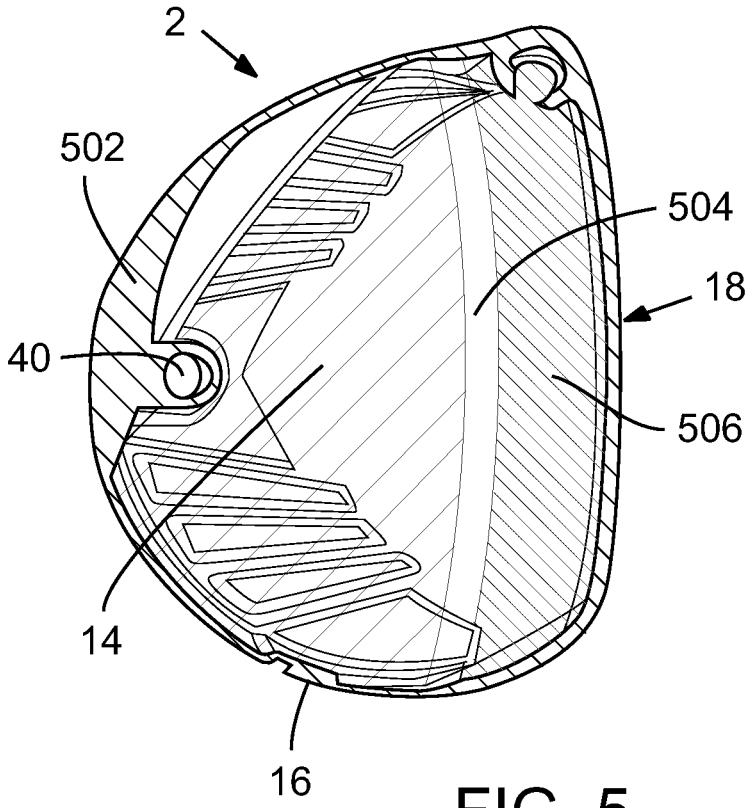
FIG. 5 is a cross-sectional view of the golf club head of FIG. 1 taken along line 5-5 of FIG. 2 and showing internal features of the embodiment of FIG. 1.

As used herein, "sole" means a lower portion of the club head 2 extending upwards from a lowest point of the club head when the club head is at normal address position. In some implementations, the sole 14 extends approximately 50% to 60% of the distance from the lowest point of the club head to the crown 12, which in some instances, can be approximately 10 mm and 12 mm for a fairway wood. For example, FIG. 5 illustrates a sole blend zone 504 that transitions from the sole 14 to the front sole 506. In the illustrated embodiment, the front sole dimension 508 extends about 15 mm rearward of the club face 18.

In other implementations, the sole 14 extends upwardly from the lowest point of the golf club head 10 a shorter distance than the sole 14 of golf club head 2. For example, in some implementations, the sole 14 extends upwardly approximately 50% to 60% of the distance from the lowest point of the club head 10 to the crown 12, which in some instances, can be between approximately 10 mm and approximately 12 mm for a fairway wood. Further, the sole 14 can define a substantially flat portion extending substantially horizontally relative to the ground 17 when in normal address position. In some implementations, the bottommost portion of the sole 14 extends substantially parallel to the ground 17 between approximately 5% and approximately 70% of the depth ($D_{ch}$) of the golf club head 10.

As used herein, "skirt" means a side portion of the club head 2 between the crown 12 and the sole 14 that extends across a periphery 34 of the club head, excluding the striking surface 22, from the toe portion 28, around the rear portion 32, to the heel portion 26.

As used herein, "striking surface" means a front or external surface of the striking face 18 configured to impact a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature. For example, referring to FIGS. 1 and 2, the striking surface 22 can have a bulge and roll each with a radius of approximately 254 mm. As illustrated by FIG. 9, the face thickness 907 for the illustrated embodiment is about 2.0 mm.

The body 10 can be made from a metal alloy (e.g., an alloy of titanium, an alloy of steel, an alloy of aluminum, and/or an alloy of magnesium), a composite material, such as a graphitic composite, a ceramic material, or any combination thereof. The crown 12, sole 14, and skirt 16 can be integrally formed using techniques such as molding, cold forming, casting, and/or forging and the striking face 18 can be attached to the crown, sole and skirt by known means.

For example, the striking face 18 can be attached to the body 10 as described in U.S. Patent Application Publication Nos. 2005/0239575 and 2004/0235584.

Figure 4:
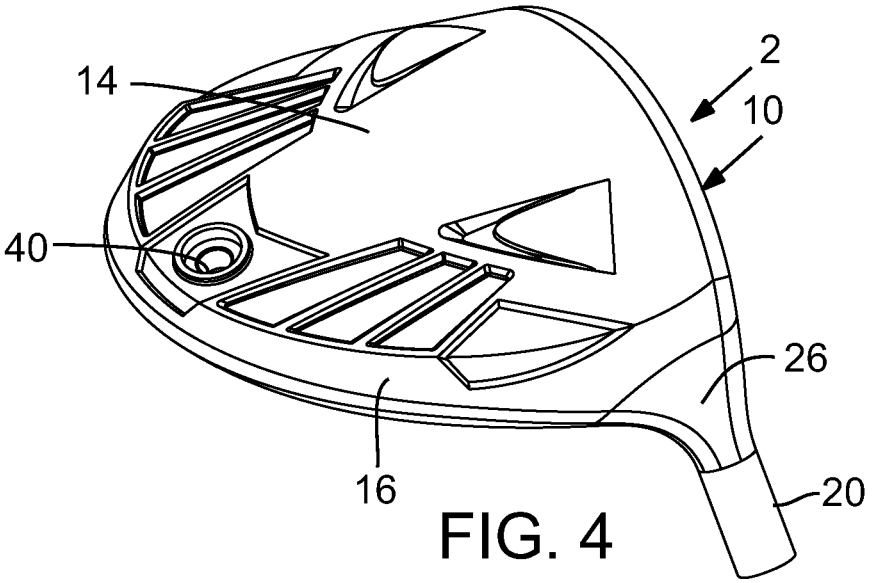
FIG. 4 is a bottom perspective view of the golf club head of FIG. 1.
Figure 7:
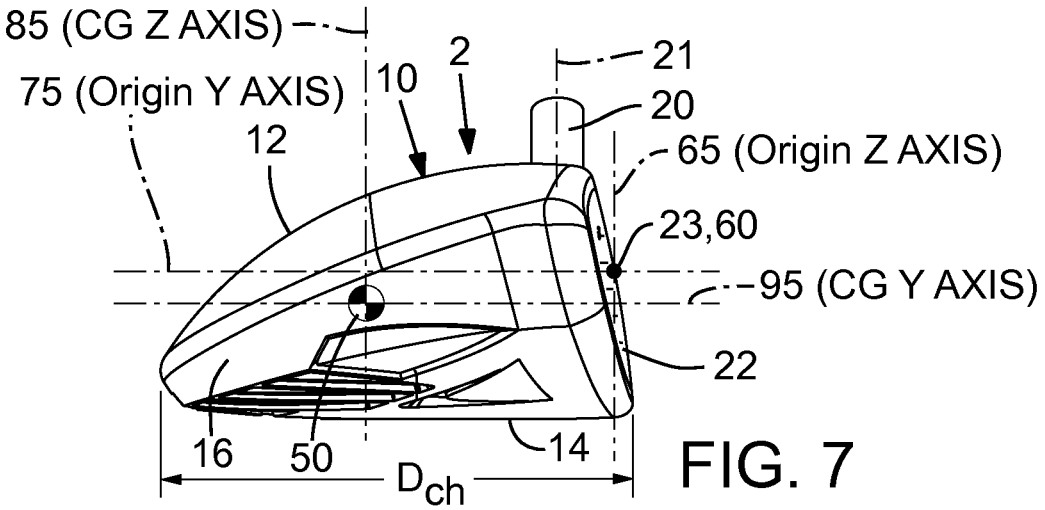
FIG. 7 is a side elevation view from the toe side of the golf club head of FIG. 1 showing the golf club head origin system and the center-of-gravity coordinate system.
Figure 8:
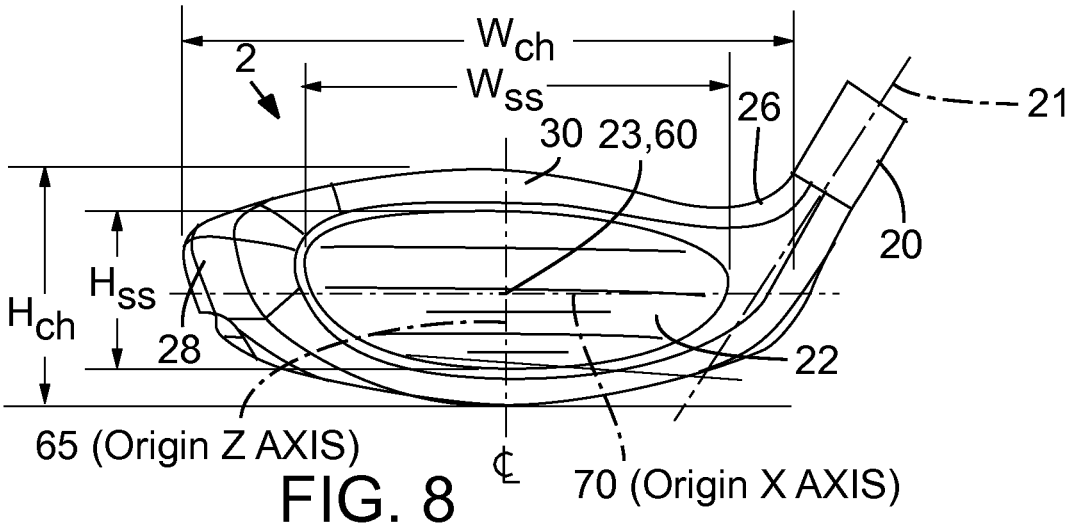
FIG. 8 is a front elevation view of the golf club head of FIG. 1, similar to FIG. 3, showing the golf club head origin system and the center-of-gravity coordinate system.

Referring to FIGS. 7 and 8, the ideal impact location 23 of the golf club head 2 is disposed at the geometric center of the striking surface 22 (see FIG. 4). The ideal impact location 23 is typically defined as the intersection of the midpoints of a height ($H_{ss}$) and a width ($W_{ss}$) of the striking surface 22. Both $H_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body (see e.g., FIG. 8). In the illustrated example, $H_{ss}$ is the distance from the periphery proximate to the sole portion of $S_{ss}$ to the perhiphery proximate to the crown portion of $S_{ss}$ measured in a vertical plane (perpendicular to ground) that extends through the geometric center of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. In some implementations, the golf club head face, or striking surface, 22, has a height ($H_{ss}$) between approximately 20 mm and approximately 40 mm, and a width ($W_{ss}$) between approximately 60 mm and approximately 100 mm. In one specific implementation, the striking surface 22 has a height ($H_{ss}$) of approximately 26 mm, width ($W_{ss}$) of approximately 71 mm, and total striking surface area of approximately 2050 $mm^2$.

In some embodiments, the striking face 18 is made of a composite material such as described in U.S. Patent Application Publication Nos. 2005/0239575 and 2004/0235584, U.S. patent application Ser. No. 11/642,310, and U.S. Provisional Patent Application No. 60/877,336, which are incorporated herein by reference. In other embodiments, the striking face 18 is made from a metal alloy (e.g., an alloy of titanium, steel, aluminum, and/or magnesium), ceramic material, or a combination of composite, metal alloy, and/or ceramic materials.

When at normal address position, the club head 2 is disposed at a lie-angle 19 relative to the club shaft axis 21 and the club face has a loft angle 15 (FIG. 2). Referring to FIG. 3, lie-angle 19 refers to the angle between the centerline axis 21 of the club shaft and the ground plane 17 at normal address position. Lie angle for a fairway wood typically ranges from about 54 degrees to about 62 degrees, most typically about 56 degrees to about 60 degrees. Referring to FIG. 2, loft-angle 15 refers to the angle between a tangent line 27 to the club face 18 and a vector normal to the ground plane 29 at normal address position. Loft angle for a fairway wood is typically greater than about 13 degrees. For example, loft for a fairway wood typically ranges from about 13 degrees to about 28 degrees, and more preferably from about 13 degrees to about 22 degrees.

Golf Club Head Coordinates

Figure 6:
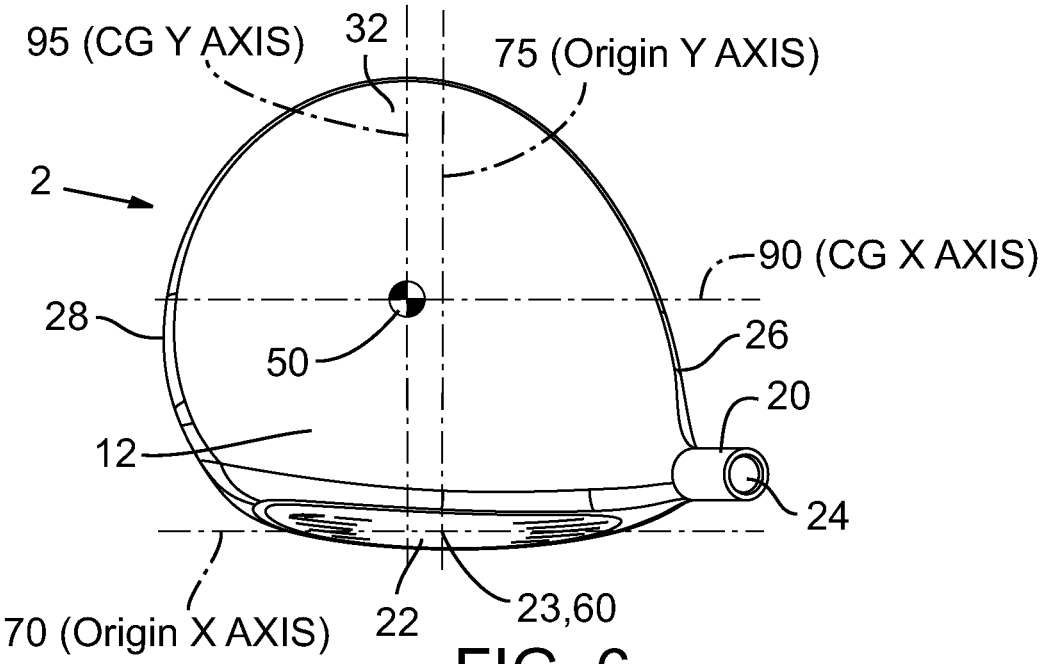
FIG. 6 is a top plan view of the golf club head of FIG. 1, similar to FIG. 1, showing a golf club head origin system and a center-of-gravity coordinate system.

Referring to FIGS. 6-8, a club head origin coordinate system can be defined such that the location of various features of the club head (including, e.g., a club head center-of-gravity (CG) 50) can be determined. A club head origin 60 is illustrated on the club head 2 positioned at the ideal impact location 23, or geometric center, of the striking surface 22.

The head origin coordinate system defined with respect to the head origin 60 includes three axes: a z-axis 65 extending through the head origin 60 in a generally vertical direction relative to the ground 17 when the club head 2 is at normal address position; an x-axis 70 extending through the head origin 60 in a toe-to-heel direction generally parallel to the striking surface 22, e.g., generally tangential to the striking surface 22 at the ideal impact location 23, and generally perpendicular to the z-axis 65; and a y-axis 75 extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at normal address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12.

An alternative, above ground, club head coordinate system places the origin 60 at the intersection of the z-axis 65 and the ground plane 17, providing positive z-axis coordinates for every club head feature.

As used herein, "Zup" means the CG z-axis location determined according to the above ground coordinate system. Zup generally refers to the height of the CG 50 above the ground plane 17.

In one embodiment, the golf club head can have a CG with an x-axis coordinate between approximately −2.0 mm and approximately 6.0 mm, a y-axis coordinate between approximately 20 mm and approximately 40 mm, a z-axis coordinate between approximately 0.0 mm and approximately −6.0 mm. In certain embodiments, a z-axis coordinate between about 0.0 mm and about −6.0 mm provides a Zup value of between approximately 10 mm and 16 mm. Referring to FIG. 1, in one specific implementation, the CG x-axis coordinate is approximately 2.5 mm, the CG y-axis coordinate is approximately 32 mm, the CG z-axis coordinate is approximately −3.5 mm, providing a Zup value of approximately 15 mm.

Another alternative coordinate system uses the club head center-of-gravity (CG) 50 as the origin when the club head 2 is at normal address position. Each center-of-gravity axis passes through the CG 50. For example, the CG x-axis 90 passes through the center-of-gravity 50 substantially parallel to the ground plane 17 and generally parallel to the origin x-axis 70 when the club head is at normal address position. Similarly, the CG y-axis 95 passes through the center-of-gravity 50 substantially parallel to the ground plane 17 and generally parallel to the origin y-axis 75, and the CG z-axis 85 passes through the center-of-gravity 50 substantially perpendicular to the ground plane 17 and generally parallel to the origin z-axis 65 when the club head is at normal address position.

Mass Moments of Inertia

Referring to FIGS. 6-8, golf club head moments of inertia are typically defined about the three CG axes that extend through the golf club head center-of-gravity 50.

For example, a moment of inertia about the golf club head CG z-axis 85 can be calculated by the following equation $$I_{zz}=\int(x^2+y^2)dm \tag{2}$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of a golf club head to resist twisting about the CG z-axis. Greater moments of inertia about the CG z-axis (Izz) provide the golf club head 2 with greater forgiveness on toe-ward or heel-ward off-center impacts with a golf ball. In other words, a golf ball hit by a golf club head on a location of the striking surface 18 between the toe 28 and the ideal impact location 23 tends to cause the golf club head to twist rearwardly and the golf ball to draw (e.g., to have a curving trajectory from right-to-left for a right-handed swing). Similarly, a golf ball hit by a golf club head on a location of the striking surface 18 between the heel 26 and the ideal impact location 23 causes the golf club head to twist forwardly and the golf ball to slice (e.g., to have a curving trajectory from left-to-right for a right-handed swing). Increasing the moment of inertia about the CG z-axis (Izz) reduces forward or rearward twisting of the golf club head, reducing the negative effects of heel or toe mis-hits.

A moment of inertia about the golf club head CG x-axis 90 can be calculated by the following equation $$I_{xx}=\int(y^2+z^2)dm \tag{1}$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. Greater moments of inertia about the CG x-axis (Ixx) improve the forgiveness of the golf club head 2 on high and low off-center impacts with a golf ball. In other words, a golf ball hit by a golf club head on a location of the striking surface 18 above the ideal impact location 23 causes the golf club head to twist upwardly and the golf ball to have a higher trajectory than desired. Similarly, a golf ball hit by a golf club head on a location of the striking surface 18 below the ideal impact location 23 causes the golf club head to twist downwardly and the golf ball to have a lower trajectory than desired. Increasing the moment of inertia about the CG x-axis (Ixx) reduces upward and downward twisting of the golf club head 2, reducing the negative effects of high and low mis-hits.

Discretionary Mass

Desired club head mass moments of inertia can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass. In other words, a reduction in wall thickness reduces the wall mass and provides mass that can be distributed elsewhere. For example, in some implementations, one or more walls of the club head can have a thickness less than approximately 0.7 mm, such as between about 0.55 mm and about 0.65 mm. In some embodiments, the crown 12 can have a thickness of approximately 0.65 mm throughout more than about 70% of the crown. See for example FIG. 9, which illustrates a back crown thickness 907 of about 0.60 mm and a front crown thickness 901 of about 0.76 mm. In addition, the skirt 16 can have a similar thickness and the wall of the sole 14 can have a thickness of approximately 1.0 mm. In contrast, conventional club heads have wall thicknesses in excess of about 0.75 mm, and some in excess of about 0.85 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

For example, FIG. 5 illustrates a cross-section of the club head 2 of FIG. 1 along line 5-5 of FIG. 2. In addition to providing a weight port 40 for adjusting the club head mass distribution, the club head 2 provides a mass pad 502 located rearward in the club head 2.

To achieve a thin wall on the club head body 10, such as a thin crown 12, a club head body 10 can be formed from an alloy of steel or an alloy of titanium. Thin wall investment casting, such as gravity casting in air for alloys of steel (FIG. 10) and centrifugal casting in a vacuum chamber for alloys of titanium (FIG. 11), provides one method of manufacturing a club head body with one or more thin walls.

Figure 10:
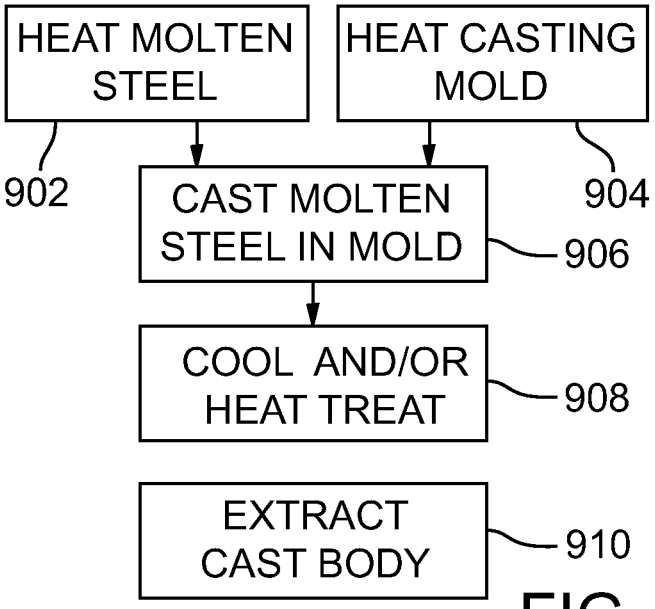
FIG. 10 is a flowchart of an investment casting process for club heads made of an alloy of steel.
Figure 11:
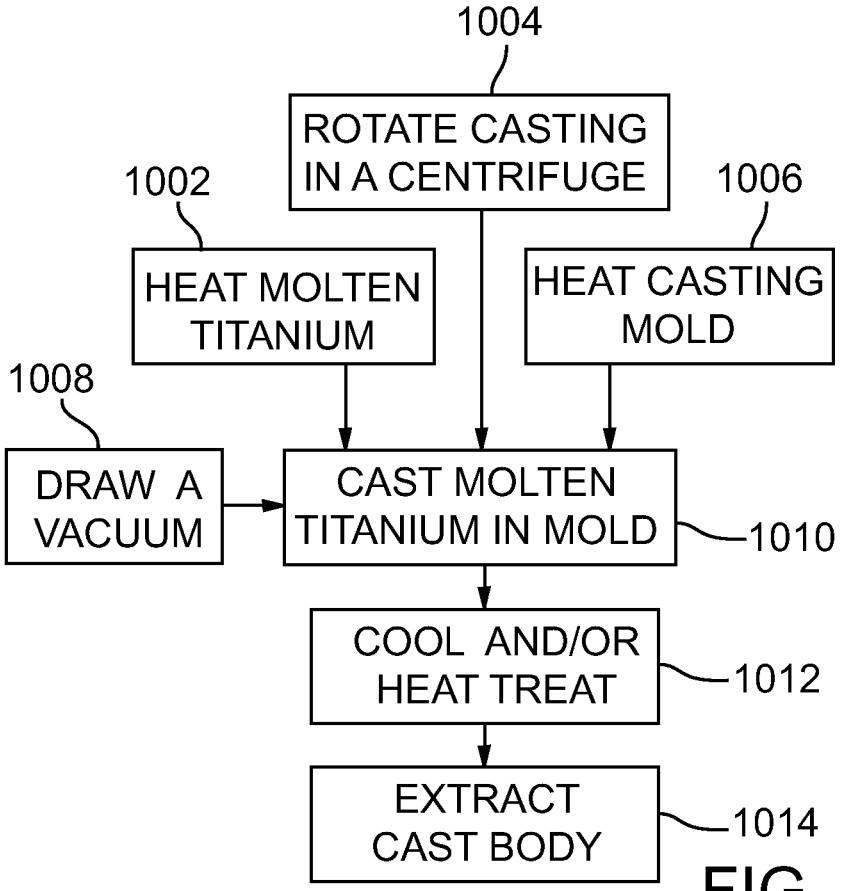
FIG. 11 is a flowchart of an investment casting process for club heads made of an alloy of titanium.

Referring to FIG. 10, a thin crown made of a steel alloy, for example between about 0.55 mm and about 0.65 mm, can be attained by heating a molten steel (902) to between about 2520 degrees Fahrenheit and about about 2780 degrees Fahrenheit, such as about 2580 degrees. In addition, the casting mold can be heated (904) to between about 660 degrees and about 1020 degrees, such as about 830 degrees. The molten steel can be cast in the mold (906) and subsequently cooled and/or heat treated (908). The cast steel body 10 can be extracted from the mold (910) prior to applying any secondary machining operations or attaching a striking face 18.

Alternatively, a thin crown made from an alloy of titanium. In some embodiments of a titanium casting process, modifying the gating provides improved flow of molten titanium, aiding in casting thin crowns. For further details concerning titanium casting, please refer to U.S. patent application Ser. No. 11/648,013, incorporated herein by reference. In addition, the casting mold can be heated (1006) to between about 620 degrees Fahrenheit and about 930 degrees, such as about 720 degrees. The casting can be rotated in a centrifuge (1004) at a rotational speed between about 200 RPM and about 800 RPM, such as about 500 RPM. Molten titanium can be heated (1002) to between about 3000 degrees Fahrenheit and about 3750 degrees Fahrenheit, such as between about 3025 degrees Fahrenheit and about 3075 degrees Fahrenheit. Molten titanium can be cast in the mold (1010) and the cast body can be cooled and/or heat treated (1012). The cast titanium body 10 can be extracted from the mold (1014) prior to applying secondary machining operations or attaching the striking face.

Weights and Weight Ports

Various approaches can be used for positioning discretionary mass within a golf club head. For example, many club heads have integral sole weight pads cast into the head at predetermined locations that can be used to lower the club head's center-of-gravity. Also, epoxy can be added to the interior of the club head through the club head's hosel opening to obtain a desired weight distribution. Alternatively, weights formed of high-density materials can be attached to the sole, skirt, and other parts of a club head. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Alternatively, the golf club head 2 can define one or more weight ports 40 formed in the body 10 that are configured to receive one or more weights. For example, one or more weight ports can be disposed in the crown 12, skirt 16 and/or sole 14. The weight port 40 can have any of a number of various configurations to receive and retain any of a number of weights or weight assemblies, such as described in U.S. patent application Ser. Nos. 11/066,720 and 11/065,772, which are incorporated herein by reference. For example, FIG. 9 illustrates a cross-sectional view that shows one example of the weight port 40 removably engageable with the sole 14. The illustrated weight port 40 defines internal threads 46 that correspond to external threads formed on the weight 80. Weights and/or weight assemblies configured for weight ports in the sole can vary in mass from about 0.5 grams to about 10 grams.

Inclusion of one or more weights in the weight port(s) 40 provides a customizable club head mass distribution, and corresponding mass moments of inertia and center-of-gravity 50 locations. Adjusting the location of the weight port(s) 40 and the mass of the weights and/or weight assemblies provides various possible locations of center-of-gravity 50 and various possible mass moments of inertia using the same club head 2.

As discussed in more detail below, a playable fairway wood club head can have a low, rearward center-of-gravity. Placing a weight port rearward in the sole helps desirably locate the center-of-gravity. Although other methods (e.g., using internal weights attached using epoxy or hot-melt glue) of adjusting the center-of-gravity can be used, use of a weight port reduces undesirable effects on the audible tone emitted during impact with a golf ball.

Club Head Height and Length

In addition to redistributing mass within a particular club head envelope as discussed immediately above, the club head center-of-gravity location 50 can also be tuned by modifying the club head external envelope. For example, the club head body 10 can be extended rearwardly, and the overall height can be reduced.

Referring now to FIG. 8, the club head 2 has a maximum club head height ($H_{ch}$) defined as the maximum above ground z-axis coordinate of the outer surface of the crown 12. Similarly, a maximum club head width ($W_{ch}$) can be defined as the distance between the maximum extents of the heel and toe portions 26, 28 of the body measured along an axis parallel to the x-axis when the club head 2 is at normal address position and a maximum club head depth ($D_{ch}$), or length, defined as the distance between the forwardmost and rearwardmost points on the surface of the body 10 measured along an axis parallel to the y-axis when the club head 2 is at normal address position. Generally, the height and width of club head 2 should be measured according to the USGA "Procedure for Measuring the Clubhead Size of Wood Clubs" Revision 1.0.

In some embodiments, the fairway wood golf club head 2 has a height ($H_{ch}$) less than approximately 50 mm. In some embodiments, the club head 2 has a height ($H_{ch}$) less than about 35 mm. For example, some implementations of the golf club head 2 have a height ($H_{ch}$) less than about 38 mm. In other implementations, the golf club head 2 has a height ($H_{ch}$) less than about 42 mm. Still other implementations of the golf club head 2 have a height ($H_{ch}$) less than about 46 mm.

Some examples of the golf club head 2 have a depth ($D_{ch}$) greater than approximately 75 mm. For example, as discussed in more detail below, the golf club head 2 can have a depth ($D_{ch}$) greater than about 85 mm.

Forgiveness of Fairway Woods

Golf club head "forgiveness" generally describes the ability of a club head to deliver a desirable golf ball trajectory despite a mis-hit. As described above, large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood club heads, such as the club head 2, can be improved using the techniques described above to achieve high moments of inertia and low center-of-gravity compared to conventional fairway wood golf club heads. For example, a club head 2 with a crown thickness less than about 0.65 mm throughout at least about 70% of the crown can provide significant discretionary mass. A 0.60 mm thick crown can provide as much as about 8 grams of discretionary mass compared to a 0.80 mm thick crown. The large discretionary mass can be distributed to improve the mass moments of inertia and desirably locate the club head center-of-gravity. Generally, discretionary mass should be located sole-ward rather than crown-ward to maintain a low center-of-gravity, and rearward rather than forward to maintain a rearwardly positioned center-of-gravity. In addition, discretionary mass should be located far from the center-of-gravity and near the perimeter of the club head to maintain high mass moments of inertia.

For example, a comparatively forgiving golf club head 2 for a fairway wood can combine an overall club head height ($H_{ch}$) of less than about 46 mm and an above ground center-of-gravity location, Zup, less than about 19 mm. Some examples of the club head 2 provide an above ground center-of-gravity location, Zup, less than about 16 mm.

In addition, a thin crown 12 as described above provides sufficient discretionary mass to allow the club head 2 to have a volume less than about 240 $cm^3$ and/or a front to back depth ($D_{ch}$) greater than about 85 mm. Without a thin crown 12, a similarly sized golf club head would either be overweight or would have an undesirably located center-of-gravity because less discretionary mass would be available to tune the CG location.

In addition, discretionary mass can be distributed to provide a mass moment of inertia about the CG z-axis 85, $I_{zz}$, greater than about 300 kg-$mm^2$ In some instances, the mass moment of inertia about the CG z-axis 85, $I_{zz}$, can be greater than about 320 kg-$mm^2$, such as greater than about 340 kg-$mm^2$ or greater than about 360 kg-$mm^2$ Distribution of the discretionary mass can also provide a mass moment of inertia about the CG x-axis 90, $I_{xx}$, greater than about 150 kg-$mm^2$ In some instances, the mass moment of inertia about the CG x-axis 85, $I_{xx}$, can be greater than about 170 kg-$mm^2$, such as greater than about 190 kg-$mm^2$.

Alternatively, some examples of a forgiving club head 2 combine an above ground center-of-gravity location, Zup, less than about 19 mm and a high moment of inertia about the CG z-axis 85, $I_{zz}$. In such club heads, the moment of inertia about the CG z-axis 85, $I_{zz}$, specified in units of kg-$mm^2$, together with the above ground center-of-gravity location, Zup, specified in units of millimeters (mm), can satisfy the relationship $$I_{zz} \geq 13 \cdot Zup + 105.$$

Alternatively, some forgiving fairway wood club heads have a moment of inertia about the CG z-axis 85, $I_{zz}$, and a moment of inertia about the CG x-axis 90, $I_{xx}$, specified in units of kg-$mm^2$, together with an above ground center-of-gravity location, Zup, specified in units of millimeters, that satisfy the relationship $$I_{xx} + I_{zz} \geq 20 \cdot Zup + 165.$$

As another alternative, a forgiving fairway wood club head can have a moment of inertia about the CG x-axis, $I_{xx}$, specified in units of kg-$mm^2$, and, an above ground center-of-gravity location, Zup, specified in units of millimeters, that together satisfy the relationship $$I_{xx} \geq 7 \cdot Zup + 60.$$

EXAMPLES

Table 1 summarizes characteristics of two exemplary 3-wood club heads that embody one or more of the above described aspects. In particular, the exemplary club heads achieve desirably low centers of gravity in combination with high mass moments of inertia.

Example 1

Club heads formed according to the Example 1 embodiment are formed largely of an alloy of steel. As indicated by Table 1 and depending on the manufacturing tolerances achieved, the mass of club heads according to Example 1 is between about 210 g and about 220 grams and the Zup dimension is between about 13 mm and about 17 mm. As designed, the mass of the Example 1 design is 216.1 g and the Zup dimension 15.2 mm. The loft is about 16 degrees, the overall club head height is about 38 mm, and the head depth is about 87 mm. The crown is about 0.60 mm thick. The relatively large head depth in combination with a thin and light crown provides significant discretionary mass for redistribution to improve forgiveness and overall playability. For example, the resulting mass moment of inertia about the CG z-axis (Izz) is about 325 kg-$mm^2$.

Example 2

Club heads formed according to the Example 2 embodiment are formed largely of an alloy of titanium. As indicated by Table 1 and depending on the manufacturing tolerances achieved, the mass of club heads according to Example 2 is between about 210 g and about 220 grams and the Zup dimension is between about 13 mm and about 17 mm. As designed, the mass of the Example 2 design is 213.8 g and the Zup dimension 14.8 mm. The loft is about 15 degrees, the overall club head height is about 40.9 mm, and the head depth is about 97.4 mm. The crown is about 0.80 mm thick. The relatively large head depth in combination with a thin and light crown provides significant discretionary mass for redistribution to improve forgiveness and overall playability. For example, the resulting mass moment of inertia about the CG z-axis (Izz) is about 302 kg-mm$^2$.

Overview of Examples

Both of these examples provide improved playability compared to conventional fairway woods, in part by providing desirable combinations of low CG position, e.g., a Zup dimension less than about 16 mm, and high moments of inertia, e.g., $I_{zz}$ greater than about 300 kg-mm$^2$, $I_{xx}$ greater than about 170 kg-mm$^2$, and a shallow head height, e.g., less than about 46 mm. Such examples are possible, in part, because they incorporate an increased head depth, e.g., greater than about 85 mm, in combination with a thinner, lighter crown compared to conventional fairway woods. These features provide significant discretionary mass for achieving desirable characteristics, such as, for example, high moments of inertia and low CG.

TABLE 1

Summary of Examples

| Exemplary Embodiment | Units | Example 1 | Example 2 |
|---|---|---|---|
| Mass | g | 216.1 | 213.8 |
| Volume | cc | 181.0 | 204.0 |
| CGX | mm | 2.5 | 4.7 |
| CGY | mm | 31.8 | 36.1 |
| CGZ | mm | −3.54 | −4.72 |
| Z Up | mm | 15.2 | 14.8 |
| Ixx | kg-mm2 | 179 | 171 |
| Izz | kg-mm2 | 325 | 302 |
| Loft | ° | 16 | 15 |
| Lie | ° | 58.5 | 58.5 |
| Bulge Radius | mm | 254 | 254 |
| Roll Radius | mm | 254 | 254 |
| Face Width | mm | 77.1 | 77.1 |
| Face Height | mm | 26.3 | 30.6 |
| Face Area | mm2 | 2006 | 2294 |
| Head Height | mm | 38 | 40.9 |
| Head Width | mm | 102.5 | 97.2 |
| Head Depth | mm | 87.8 | 97.4 |
| Face Thickness | mm | 2.00 | 2.30 |
| Crown Thickness | mm | 0.60 | 0.80 |
| Sole Thickness | mm | 1.00 | 2.50 |

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club head, comprising:

a body defining an interior cavity, a sole portion positioned at a bottom portion of the golf club head, a crown portion positioned at a top portion, and a skirt portion positioned around a periphery between the sole and crown, the body also having a forward portion and a rearward portion and a maximum above ground height;

at least one weight port formed in the body to support varying weights of at least about 0.5 gram; and a face positioned at the forward portion of the body;

wherein:

the golf club head has an above ground center-of-gravity location, Zup, less than about 19 mm, the golf club head has a center-of-gravity location as measured along a coordinate system having an origin located at a center of the face, the center-of-gravity location being between about −2.0 mm and about 6.0 mm along an x-axis arranged parallel to the ground plane and tangent to the face, the center-of-gravity location being between about 20 mm and about 40 mm along a y-axis arranged parallel to the ground plane and perpendicular to the x-axis, and the center-of-gravity location being up to 0 mm along a z-axis arranged perpendicular to both the x-axis and y-axis wherein a positive z-axis measurement is away from the ground plane and a negative z-axis measurement is toward the ground plane, the z-axis origin being situated at 0 mm, the golf club head has a moment of inertia about a center-of-gravity x-axis, $I_{xx}$, greater than about 150 kg-mm$^2$, and the golf club head has a total mass between about 185 g and about 245 g.

2. The golf club head of claim 1, wherein the above ground center-of-gravity location, Zup, and the moment of inertia about the center-of-gravity z-axis, $I_{zz}$, specified in units of kg-mm$^2$, together satisfy $$I_{zz} \geq 13 \cdot Zup + 105.$$

3. The golf club head of claim 1, wherein the moment of inertia about the center-of-gravity z-axis, $I_{zz}$, exceeds one or more of 300 kg-mm$^2$, 320 kg-mm$^2$, 340 kg-mm$^2$, and 360 kg-mm$^2$.

4. The golf club head of claim 1, further comprising at least one weight configured to be retained at least partially within the at least one weight port.

5. The golf club head of claim 1, wherein the face has a loft angle in excess of about 13 degrees.

6. The golf club head of claim 1, wherein the golf club head has volume less than about 240 cm$^3$.

7. The golf club head of claim 1, wherein the body is substantially formed from a material selected from the group of materials consisting of a steel alloy, a titanium alloy, a graphitic composite, and a combination thereof.

8. The golf club head of claim 7, wherein the body is substantially formed as an investment casting.

9. The golf club head of claim 1, wherein the maximum above ground height is less than about 46 mm.

10. The golf club head of claim 1, wherein the maximum above ground height is less than about 42 mm.

11. The golf club head of claim 1, wherein the maximum above ground height is less than about 38 mm.

12. A golf club head, comprising:

a body defining an interior cavity, a sole portion positioned at a bottom portion of the golf club head and having at least an exterior surface formed of a single material, a crown portion positioned at a top portion, and a skirt portion positioned around a periphery between the sole and crown, the body also having a forward portion and a rearward portion and a maximum above ground height; and a face positioned at the forward portion of the body;

wherein:

the body height is less than 46 mm, the golf club head has an above ground center-of-gravity location, Zup, less than about 19 mm, the golf club head has a center-of-gravity location as measured along a coordinate system having an origin located at a center of the face, the center-of-gravity location being between about −2.0 mm and about 6.0 mm along an x-axis arranged parallel to the ground plane and tangent to the face, the center-of-gravity location being between about 20 mm and about 40 mm along a y-axis arranged parallel to the ground plane and perpendicular to the x-axis, and the center-of-gravity location being up to 0 mm along a z-axis arranged perpendicular to both the x-axis and y-axis wherein a positive z-axis measurement is away from the ground plane and a negative z-axis measurement is toward the ground plane, the z-axis origin being situated at 0 mm, the golf club head has a moment of inertia about a center-of-gravity x-axis, $I_{xx}$, greater than about 150 kg-mm$^2$, and the golf club head has a volume between about 120 cm$^3$ and about 240 cm$^3$.

13. The golf club head of claim 12, wherein the above ground center-of-gravity location, Zup, and the moment of inertia about the center-of-gravity z-axis, $I_{zz}$, specified in units of kg-mm$^2$, together satisfy $$I_{zz} \geq 13 \cdot Zup + 105.$$

14. The golf club head of claim 12, wherein the moment of inertia about the center-of-gravity z-axis, $I_{zz}$, exceeds 300 kg-mm$^2$.

15. The golf club head of claim 12, wherein the moment of inertia about the center-of-gravity z-axis, $I_{zz}$, exceeds 360 kg-mm$^2$.

16. The golf club head of claim 12, further comprising:

one or more weight ports formed in the body; and at least one weight configured to be retained at least partially within one of the one or more weight ports.

17. The golf club head of claim 12, wherein the face has a loft angle in excess of about 13 degrees.

18. The golf club head of claim 12, wherein the golf club head has a volume less than about 240 cm$^3$.

19. The golf club head of claim 12, wherein the body is substantially formed from a material selected from the group of materials consisting of a steel alloy, a titanium alloy, a graphitic composite, and a combination thereof.

20. The golf club head of claim 19, wherein the body is substantially formed as an investment casting.

21. The golf club head of claim 12, wherein the maximum height is less than about 42 mm.

22. The golf club head of claim 12, wherein the maximum height is less than about 38 mm.

23. A golf club head, comprising:

a body defining an interior cavity, a sole portion positioned at a bottom portion of the golf club head, a crown portion positioned at a top portion, and a skirt portion positioned around a periphery between the sole and crown, the body also having a forward portion and a rearward portion and a maximum above ground height; and a face positioned at the forward portion of the body;

wherein:

the body height is less than about 46 mm, the face has a loft angle less than about 28 degrees, the golf club head has an above ground center-of-gravity location, Zup, less than about 19 mm, and a moment of inertia about a center-of-gravity z-axis, $I_{zz}$, that together satisfy, $$I_{zz} \geq 13 \cdot Zup + 105,$$

the golf club head has a center-of-gravity location as measured along a coordinate system having an origin located at a center of the face, the center-of-gravity location being between about −2.0 mm and about 6.0 mm along an x-axis arranged parallel to the ground plane and tangent to the face, the center-of-gravity location being between about 0 mm and about 40 mm along a y-axis arranged parallel to the ground plane and perpendicular to the x-axis, and the center-of-gravity location being up to 0 mm along a z-axis arranged perpendicular to both the x-axis and y-axis wherein a positive z-axis measurement is away from the ground plane and a negative z-axis measurement is toward the ground plane, the z-axis origin being situated at 0 mm, the golf club head has a volume between about 120 cm$^3$ and about 240 cm$^3$, and the golf club head has a total mass between about 185 g and about 245 g.

24. The golf club head of claim 23, wherein the above ground center-of-gravity location, Zup, is less than about 16 mm.

25. The golf club head of claim 23, wherein the crown has a thickness less than about 0.65 mm over at least about 70% of the crown.

26. The golf club head of claim 23, wherein the face has a loft angle less than about 22 degrees.

* * * * *